US011424056B2

(12) United States Patent
Nozawa

(10) Patent No.: US 11,424,056 B2
(45) Date of Patent: Aug. 23, 2022

(54) METHOD FOR PRODUCING SINTERED R-T-B BASED MAGNET

(71) Applicant: HITACHI METALS, LTD., Tokyo (JP)

(72) Inventor: Noriyuki Nozawa, Minato-ku (JP)

(73) Assignee: HITACHI METALS, LTD., Tokyo (JP)

( * ) Notice: Subject to any disclaimer, the term of this patent is extended or adjusted under 35 U.S.C. 154(b) by 213 days.

(21) Appl. No.: 16/752,910

(22) Filed: Jan. 27, 2020

(65) Prior Publication Data

US 2020/0243234 A1 Jul. 30, 2020

(30) Foreign Application Priority Data

Jan. 28, 2019 (JP) ..... JP2019-012162
Sep. 27, 2019 (JP) ..... JP2019-176504

(51) Int. Cl.

| | |
|---|---|
| ***H01F 1/057*** | (2006.01) |
| ***C22C 38/02*** | (2006.01) |
| ***C22C 38/00*** | (2006.01) |
| ***C22C 38/04*** | (2006.01) |
| ***C22C 38/06*** | (2006.01) |
| ***C22C 38/10*** | (2006.01) |

(Continued)

(52) U.S. Cl.

CPC ..... *H01F 1/0577* (2013.01); *C22C 38/002* (2013.01); *C22C 38/005* (2013.01); *C22C 38/02* (2013.01); *C22C 38/04* (2013.01); *C22C 38/06* (2013.01); *C22C 38/10* (2013.01); *C22C 38/16* (2013.01); *H01F 41/0293* (2013.01); *C22C 2202/02* (2013.01)

(58) Field of Classification Search

CPC ..... H01F 1/0577; H01F 41/0253; H01F 41/0266; H01F 41/0293; C22C 38/002; C22C 38/005; C22C 38/02; C22C 38/04; C22C 38/06; C22C 38/10; C22C 38/16; C22C 2202/02

See application file for complete search history.

(56) References Cited

U.S. PATENT DOCUMENTS

| | | | | |
|---|---|---|---|---|
| 2008/0286595 | A1 | 11/2008 | Yoshimura et al. | |
| 2018/0025819 | A1 | 1/2018 | Shigemoto et al. | |
| 2018/0240590 | A1* | 8/2018 | Kuniyoshi ..... | H01F 41/02 |

(Continued)

FOREIGN PATENT DOCUMENTS

| | | | |
|---|---|---|---|
| EP | 3 579 257 | A1 | 12/2019 |
| WO | 2007/102391 | A1 | 9/2007 |

(Continued)

*Primary Examiner* — Anthony M Liang
*Assistant Examiner* — Danny N Kang
(74) *Attorney, Agent, or Firm* — Keating & Bennett, LLP

(57) ABSTRACT

A method for producing a sintered R-T-B based magnet includes: a step of providing a sintered R-T-B based magnet work; a step of providing an RL-RH-M based alloy; and a diffusion step. In the diffusion step, an adhering amount of the RL-RH-M based alloy to the magnet work is 4 to 15 mass %, and an adhering amount of RH is 0.1 to 0.6 mass %; in the magnet work, the R content accounts for 27 to 35 mass %, the Fe content in the entire T accounting for 80 mass % or more; and, in the RL-RH-M based alloy, the RL content accounts for 60 to 97 mass %; the RH content accounting for 1 to 8 mass %; and the M content accounts for 2 to 39 mass %.

4 Claims, 2 Drawing Sheets

(51) Int. Cl.
*C22C 38/16* (2006.01)
*H01F 41/02* (2006.01)

(56) References Cited

U.S. PATENT DOCUMENTS

2018/0247743 A1* 8/2018 Li ..... C22C 1/02
2019/0371522 A1 12/2019 Kuniyoshi

FOREIGN PATENT DOCUMENTS

WO 2016/133071 A1 8/2016
WO 2018/143229 A1 8/2018
WO 2018/143230 A1 8/2018

* cited by examiner

METHOD FOR PRODUCING SINTERED R-T-B BASED MAGNET

BACKGROUND

1. Technical Field

The present invention relates to a method for producing a sintered R-T-B based magnet.

2. Description of the Related Art

Sintered R-T-B based magnets (where R is at least one rare-earth element; T is mainly Fe; and B is boron) are known as permanent magnets with the highest performance, and are used in voice coil motors (VCM) of hard disk drives, various types of motors such as motors for electric vehicles (EV, HV, PHV, etc.) and motors for industrial equipment, home appliance products, and the like.

A sintered R-T-B based magnet is composed of a main phase which mainly consists of an $R_2T_{14}B$ compound and a grain boundary phase that is at the grain boundaries of the main phase. The $R_2T_{14}B$ compound, which is the main phase, is a ferromagnetic material having a high saturation magnetization and anisotropic magnetic field, and provides a basis for the properties of a sintered R-T-B based magnet.

There exists a problem in that coercivity $H_{cJ}$ (which will hereinafter be simply referred to as "$H_{cJ}$") of sintered R-T-B based magnets decreases at high temperatures, thus causing an irreversible thermal demagnetization. For this reason, sintered R-T-B based magnets for use in motors for electric vehicles, in particular, are required to have high $H_{cJ}$ at high temperatures, i.e., to have higher $H_{cJ}$ at room temperature.

Patent Document 1: International Publication No. 2007/102391

Patent Document 2: International Publication No. 2016/133071

SUMMARY

It is known that $H_{cJ}$ is improved if a light rare-earth element (mainly Nd, Pr) in an $R_2T_{14}B$-based compound phase, is replaced with a heavy rare-earth element (mainly Dy, Tb). However, while $H_{cJ}$ may be improved, there is a problem in that the remanence $B_r$ (which hereinafter will be simply referred to as "$B_r$") may lower because of decreasing the saturation magnetization of the $R_2T_{14}B$-based compound phase.

Patent Document 1 describes, while supplying a heavy rare-earth element such as Dy onto the surface of a sintered magnet of an R-T-B based alloy, allowing the heavy rare-earth element to diffuse into the interior of the sintered magnet. According to the method described in Patent Document 1, Dy is diffused from the surface of the sintered R-T-B based magnet into the interior, thus allowing Dy to thicken only in the outer crust of a main phase crystal grain that is effective for $H_{cJ}$ improvement, whereby high $H_{cJ}$ can be obtained with a suppressed decrease in $B_r$.

Patent Document 2 describes allowing an R—Ga—Cu alloy of a specific composition to be in contact with the surface of an R-T-B based sintered compact and performing a heat treatment, thus to control the composition and thickness of a grain boundary phase in the sintered R-T-B based magnet and improve $H_{cJ}$.

In recent years, however, it is desired to obtain even higher Br and higher $H_{cJ}$ while reducing the amount of any heavy rare-earth element used, especially in motors for electric vehicles or the like.

Various embodiments of the present disclosure provide a method for producing a sintered R-T-B based magnet which has high $B_r$ and high $H_{cJ}$ while reducing the amount of any heavy rare-earth element used.

In an illustrative embodiment, a method for producing a sintered R-T-B based magnet according to the present disclosure comprises: a step of providing a sintered R-T-B based magnet work; a step of providing an RL-RH-M based alloy; a diffusion step of allowing at least a portion of the RL-RH-M based alloy to adhere to at least a portion of a surface of the sintered R-T-B based magnet work, and conducting a heating at a temperature which is not lower than 700° C. and not higher than 1100° C. in a vacuum or an inert gas ambient. In the diffusion step, an adhering amount of the RL-RH-M based alloy to the sintered R-T-B based magnet work is not less than 4 mass % and not more than 15 mass %, and, an adhering amount of RH to the sintered R-T-B based magnet work that is ascribable to the RL-RH-M based alloy is not less than 0.1 mass % and not more than 0.6 mass %; in the sintered R-T-B based magnet work, R is a rare-earth element which always includes at least one selected from the group consisting of Nd, Pr and Ce, the R content accounting for not less than 27 mass % and not more than 35 mass % of the entire sintered R-T-B based magnet work; T is at least one selected from the group consisting of Fe, Co, Al, Mn and Si, where T always includes Fe, the Fe content in the entire T accounting for 80 mass % or more; and, in the RL-RH-M based alloy, RL is at least one light rare-earth element which always includes at least one selected from the group consisting of Nd, Pr and Ce, the RL content accounting for not less than 60 mass % and not more than 97 mass % of the entire RL-RH-M based alloy; RH is at least one selected from the group consisting of Tb, Dy and Ho, the RH content accounting for not less than 1 mass % and not more than 8 mass % of the entire RL-RH-M based alloy; and M is at least one selected from the group consisting of Cu, Ga, Fe, Co, Ni and Al, the M content accounting for not less than 2 mass % and not more than 39 mass % of the entire RL-RH-M based alloy.

In one embodiment, in the RL-RH-M based alloy, the RH content accounts for not less than 2 mass % and not more than 6 mass % of the entire RL-RH-M based alloy.

In one embodiment, in the diffusion step, an adhering amount of the RL-RH-M based alloy to the sintered R-T-B based magnet work is not less than 5 mass % and not more than 10 mass %.

According to an embodiment of the present disclosure, a method for producing a sintered R-T-B based magnet having high $B_r$ and high $H_{cJ}$, while reducing the amount of any heavy rare-earth element used.

DETAILED DESCRIPTION

First, the fundamental structure of a sintered R-T-B based magnet according to the present disclosure will be described. The sintered R-T-B based magnet has a structure such that powder particles of a raw material alloy have bound together through sintering, and is composed of a main phase which mainly consists of $R_2T_{14}B$ compound grains and a grain boundary phase which is at the grain boundaries of the main phase.

Figure 1A:
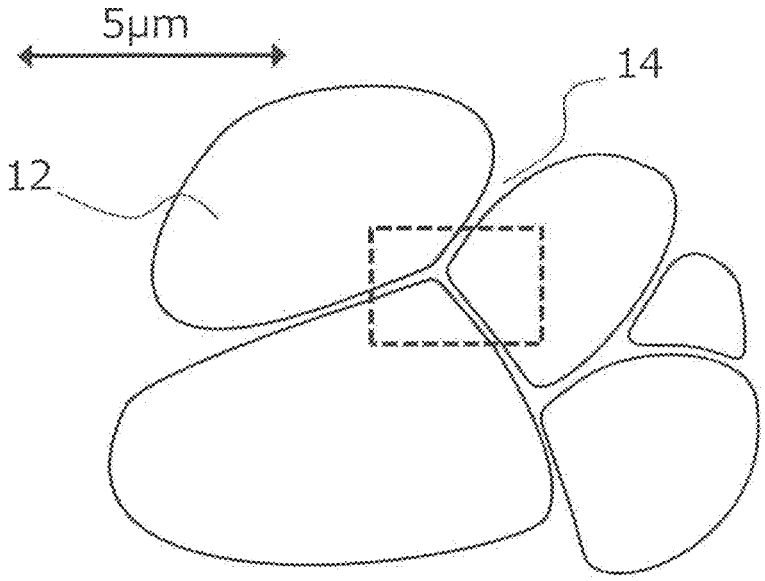
FIG. 1A is a partially enlarged cross-sectional view schematically showing a sintered R-T-B based magnet.
Figure 1B:
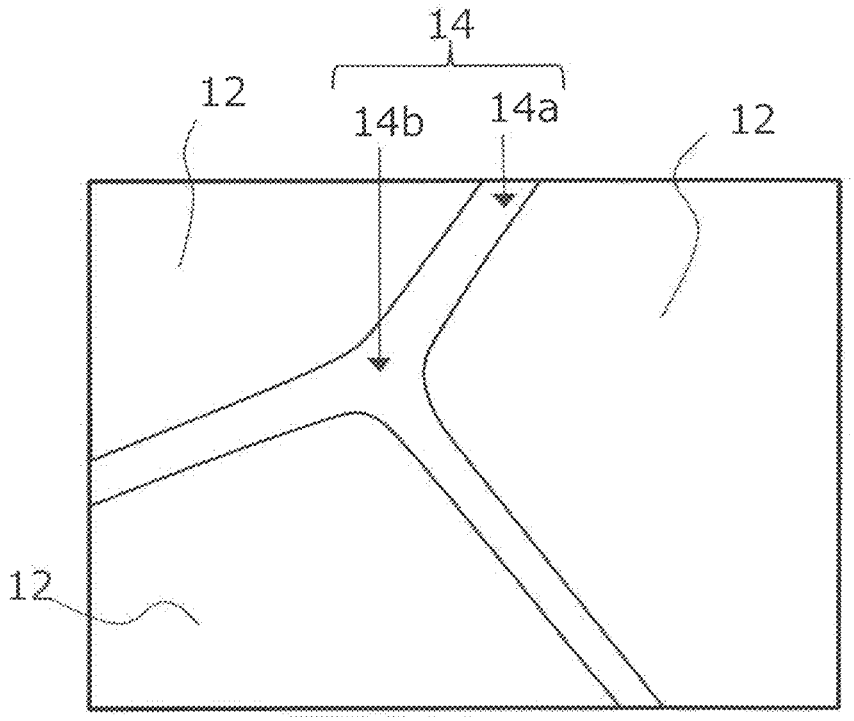
FIG. 1B is a further enlarged cross-sectional view schematically showing the interior of a broken-lined rectangular region in FIG. 1A.

FIG. 1A is a partially enlarged cross-sectional view schematically showing a sintered R-T-B based magnet. FIG. 1B is a further enlarged cross-sectional view schematically showing the interior of a broken-lined rectangular region in FIG. 1A. In FIG. 1A, arrowheads indicating a length of 5 μm are shown as an example of reference length to represent size. As shown in FIG. 1A and FIG. 1B, the sintered R-T-B based magnet is composed of a main phase which mainly consists of an $R_2T_{14}B$ compound 12 and a grain boundary phase 14 which is at the grain boundaries of the main phase 12. Moreover, as shown in FIG. 1B, the grain boundary phase 14 includes an intergranular grain boundary phase 14*a* in which two $R_2T_{14}B$ compound grains adjoin each other, and grain boundary triple junctions 14*b* at which three $R_2T_{14}B$ compound grains adjoin one another. A typical main phase crystal grain size is not less than 3 μm and not more than 10 μm, this being an average value of the diameter of an approximating circle in the magnet cross section. The main phase 12, i.e., the $R_2T_{14}B$ compound, is a ferromagnetic material having high saturation magnetization and an anisotropy field. Therefore, in a sintered R-T-B based magnet, it is possible to improve $B_r$ by increasing the abundance ratio of the $R_2T_{14}B$ compound which is the main phase 12. In order to increase the abundance ratio of the $R_2T_{14}B$ compound, the R amount, the T amount, and the B amount in the raw material alloy may be brought closer to the stoichiometric ratio of the $R_2T_{14}B$ compound (i.e., the R amount: the T amount: the B amount=2:14:1).

Moreover, it is known that, by replacing a portion of R in the $R_2T_{14}B$ compound (i.e., the main phase) with a heavy rare-earth element such as Dy, Tb or Ho, the anisotropy field of the main phase can be enhanced while reducing saturation magnetization. In particular, any main phase crust that bounds on an intergranular grain boundary phase is likely to be a point from which flux reversal may start; therefore, a heavy rare-earth diffusion technique that can replace heavy rare-earth elements in the main phase crust before anywhere else can efficiently provide a high $H_{cJ}$ while suppressing a decrease in saturation magnetization.

On the other hand, it is also known that a high $H_{cJ}$ can be obtained by controlling the magnetism of the intergranular grain boundary phase 14*a*. Specifically, by reducing the concentration of magnetic elements (Fe, Co, Ni, etc.) in the intergranular grain boundary phase in order to render the intergranular grain boundary phase near non-magnetic, the magnetic binding between main phases can be weakened, thus suppressing flux reversals.

In a method for producing a sintered R-T-B based magnet according to the present disclosure, RL and M are diffused together with the RH contained in an RL-RH-M based alloy, from the surface of the sintered R-T-B based magnet work, through grain boundaries, and into the magnet work interior. Through studies the inventor has found that, with the RH content in the RL-RH-M based alloy being kept low, when all of RH, RL and M are diffused while the adhering amount of RH to the surface of the sintered R-T-B based magnet work is controlled to be in a relatively large specific range, diffusion-based improvements in the significant anisotropy field concerning the main phase crust are obtained even with small amounts of RH, and that a significant decrease in the magnetic element concentration in the intergranular grain boundary phase is caused by diffusion of the RL and M elements into the intergranular grain boundary phase. As a result, while suppressing a decrease in $B_r$, it is possible to obtain high $H_{cJ}$. In other words, the present disclosure is based on a finding that high $B_r$ and high $H_{cJ}$ can be obtained by allowing RH being contained in an amount within a specific range (not less than 1 mass % and not more than 8 mass %), together with RL and M, to adhere and diffuse into the magnet work interior so as to result in a specific range (i.e., so that there is an adhering amount of an RH-RL-M alloy not less than 4 mass % and not more than 15 mass % to the surface of the sintered R-T-B based magnet work, and that there is an adhering amount of RH not less than 0.1 mass % and not more than 0.6 mass % to the sintered R-T-B based magnet work that is ascribable to the RL-RH-M based alloy).

Figure 2:
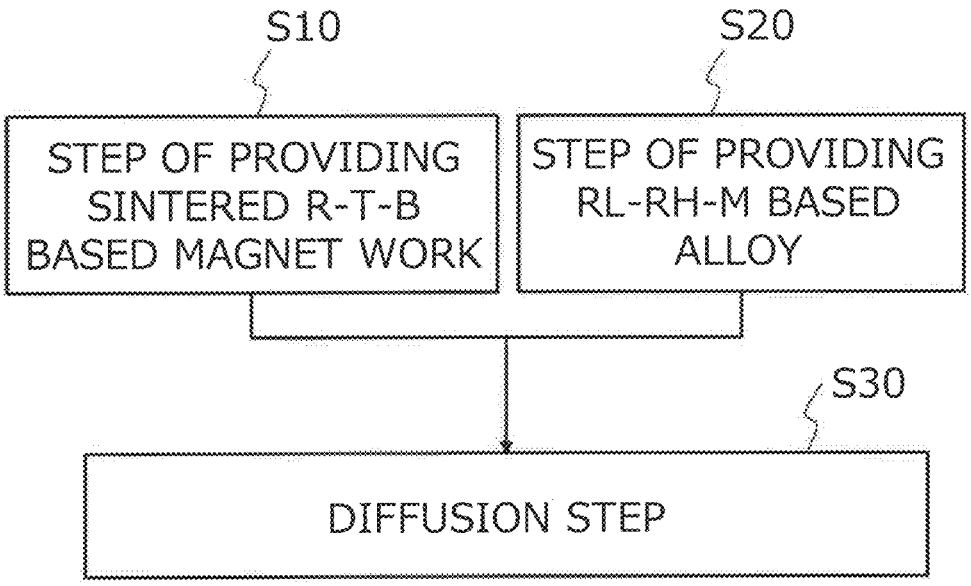
FIG. 2 is a flowchart showing example steps in a method for producing a sintered R-T-B based magnet according to the present disclosure.

A method for producing a sintered R-T-B based magnet according to the present disclosure includes, as shown in FIG. 2, step S10 of providing a sintered R-T-B based magnet work and step S20 of providing an RL-RH-M based alloy. The order of step S10 of providing a sintered R-T-B based magnet work and step S20 of providing an RL-RH-M alloy may be arbitrary; and a sintered R-T-B based magnet work and an RL-RH-M alloy were have been provided in different places may be used.

The method for producing a sintered R-T-B based magnet according to the present disclosure further includes, as shown in FIG. 2, a diffusion step S30 of heating at least a portion of the RL-RH-M based alloy is allowed to adhere to at least a portion of the surface of the sintered R-T-B based magnet work, in a vacuum or an inert gas ambient at a temperature which is not lower than 700° C. and not higher than 1100° C. In the diffusion step S30, an adhering amount of the RL-RH-M based alloy to the sintered R-T-B based magnet work is not less than 4 mass % and not more than 15 mass %.

In the present disclosure, a sintered R-T-B based magnet existing before a diffusion step or during the diffusion step will be referred to as a "sintered R-T-B based magnet work", and a sintered R-T-B based magnet after the diffusion step will be simply referred to as a "sintered R-T-B based magnet".

(Step of Providing a Sintered R-T-B Based Magnet Work)

In the sintered R-T-B based magnet work, R is a rare-earth element which always includes at least one selected from the group consisting of Nd, Pr and Ce, the R content accounting for not less than 27 mass % and not more than 35 mass % of the entire sintered R-T-B based magnet work. T is at least one selected from the group consisting of Fe, Co, Al, Mn and Si, where T always includes Fe, the Fe content in the entire T accounting for 80 mass % or more.

If R accounts for less than 27 mass %, a liquid phase may not sufficiently occur in the sintering process, and it may be difficult for the sintered compact to become adequately dense in texture. On the other hand, if R exceeds 35 mass %, grain growth may occur during sintering, thus possibly lowering $H_{cJ}$. R is preferably not less than 28 mass % and not more than 33 mass %.

The sintered R-T-B based magnet work has the following composition range, for example:

R: 27 to 35 mass %;

B: 0.80 to 1.20 mass %;

Ga: 0 to 1.0 mass %;

X: 0 to 2 mass % (where X is at least one of Cu, Nb and Zr); and

T: contained in an amount of 60 mass % or more.

Preferably, in the sintered R-T-B based magnet work, the molar ratio [T]/[B] is more than 14.0 but not more than 15.0.

This provides a higher $H_{cJ}$. As used in the present disclosure, [T]/[B] is a ratio (a/b) between: a total (a) of the respective value of a result of dividing an analysis value (mass %) of each element (at least one selected from the group consisting of Fe, Co, Al, Mn and Si, where T always includes Fe, the Fe content in the entire T accounting for 80 mass % or more) composing T with the atomic weight of that element; and (b) a result of dividing an analysis value (mass %) of B with the atomic weight of B. The condition that the molar ratio [T]/[B] is greater than 14.0 means that there is a relatively small B amount for the T amount that is consumed in the main phase ($R_2T_{14}B$ compound) formation. It is more preferable that the molar ratio [T]/[B] is not less than 14.3 and not more than 15.0. This provides an even higher $H_{cJ}$. The B content preferably accounts for not less than 0.9 mass % but less than 1.0 mass % of the entire R-T-B based sintered compact.

A sintered R-T-B based magnet work can be provided by using a generic method for producing a sintered R-T-B based magnet, e.g., an Nd—Fe—B based sintered magnet. As one example, a raw material alloy which is produced by a strip casting method or the like may be pulverized to not less than 3 μm and not more than 10 μm by using a jet mill or the like, thereafter pressed in a magnetic field, and then sintered at a temperature of not lower than 900° C. and not higher than 1100° C.

(Step of Providing an RL-RH-M Based Alloy)

In the RL-RH-M based alloy, RL is at least one light rare-earth element which always includes at least one selected from the group consisting of Nd, Pr and Ce, the RL content accounting for not less than 60 mass % and not more than 97 mass % of the entire RL-RH-M based alloy. Examples of light rare-earth elements include La, Ce, Pr, Nd, Pm, Sm, Eu, and the like. The RH is at least one selected from the group consisting of Tb, Dy and Ho, the RH content accounting for not less than 1 mass % and not more than 8 mass % of the entire RL-RH-M based alloy. M is at least one selected from the group consisting of Cu, Ga, Fe, Co, Ni and Al, the M content accounting for not less than 2 mass % and not more than 39 mass % of the entire RL-RH-M based alloy. Examples of RL-RH-M based alloys include TbNdPrCu alloys, TbNdCePrCu alloys, TbNdGa alloys, TbNdPrGaCu alloys, and the like. Together with the RL-M alloy, a fluoride, oxide, oxyfluoride, etc., of RH may be provided. Examples of RH fluorides, oxides, and oxyfluorides include $TbF_3$, $DyF_3$, $Tb_2O_3$, $Dy_2O_3$, $Tb_4OF$, and $Dy_4OF$, for example. Through adjustments of the respective contents of RL, RH and M, the RL-RH-M based alloy may contain a small amount(s) of an element(s) (e.g., Si, Mn) other than the aforementioned elements (e.g., a total of about 2 mass %).

When RL accounts for less than 60 mass %, RH and M are less likely to be introduced into the interior of the sintered R-T-B based into the magnet work, $H_{cJ}$ may lower. When RL exceeds 97 mass %, the alloy powder during the production steps of the RL-RH-M based alloy will be very active. This may consequently cause considerable oxidization, ignition, etc., of the alloy powder. Preferably, the RL content accounts for not less than 70 mass % and not more than 95 mass % of the entire RL-RH-M based alloy. This provides a higher $H_{cJ}$.

When RH accounts for less than 1 mass %, the effect of $H_{cJ}$ improvement due to RH may not be obtained, and when RH exceeds 8 mass %, the effect of $H_{cJ}$ improvement due to RL and M may be hindered, thus possibly making it difficult to obtain a sintered R-T-B based magnet having high $B_r$ and high $H_{cJ}$ while reducing the amount of any heavy rare-earth element used. Preferably, the RH content accounts for not less than 2 mass % and not more than 6 mass % of the entire RL-RH-M based alloy. This provides a higher $B_r$ and a higher $H_{cJ}$.

When M accounts for less than 2 mass %, RL and RH are less likely to be introduced into the intergranular grain boundary phase, so that $H_{cJ}$ may not be sufficiently improved. When M exceeds 39 mass %, the RL and RH contents will lower, possibly making it difficult for $H_{cJ}$ to be sufficiently improved. Preferably, the M content is not less than 3 mass % and not more than 28 mass % of the entire RL-RH-M based alloy. This provides a higher $H_{cJ}$. Moreover, M preferably contains Ga, and more preferably further contains Cu. This provides a higher $H_{cJ}$.

The method of producing the RL-RH-M based alloy is not particularly limited. It may be produced by a roll quenching technique, or a casting technique. Moreover, such alloys may be pulverized into an alloy powder. It may be produced by a known atomizing method, such as centrifugal atomization, a rotating electrode method, gas atomization, or plasma atomization.

(Diffusion Step)

A diffusion step is performed, which involves allowing at least a portion of the RL-RH-M based alloy provided as above to adhere to at least a portion of a surface of the sintered R-T-B based magnet work provided as above, and conducting a heating at a temperature which is not lower than 700° C. and not higher than 1100° C. in a vacuum or an inert gas ambient. As a result of this, a liquid phase containing RL, RH and M is generated from the RL-RH-M alloy, and through the grain boundaries in the sintered R-T-B based magnet work, this liquid phase is introduced from the sintered work surface into the interior through diffusion. In the diffusion step, the adhering amount of the RL-RH-M based alloy to the sintered R-T-B based magnet work is set to be not less than 4 mass % and not more than 15 mass %, and the adhering amount of RH to the sintered R-T-B based magnet work that is ascribable to the RL-RH-M based alloy is set to be not less than 0.1 mass % and not more than 0.6 mass %. As a result, a very high effect of $H_{cJ}$ improvement can be obtained. If the adhering amount of the RL-RH-M based alloy to the sintered R-T-B based magnet work is less than 4 mass %, the amounts of RH, RL and M introduced into the magnet work interior may be too small to obtain high $H_{cJ}$; when it exceeds 15 mass %, the amounts of RH, RL and M introduced may be so large that $B_r$ may be greatly lowered, and not only the amount of any heavy rare-earth element used may become too large, but the RL-RH-M based alloy which did not manage to diffuse into the magnet interior may remain on the magnet surface, possibly causing other problems, e.g., problems of anticorrosiveness and processibility. Preferably, an adhering amount of the RL-RH-M based alloy to the sintered R-T-B based magnet work is not less than 5 mass % and not more than 10 mass %. This provides a higher $H_{cJ}$. Moreover, if the adhering amount of RH to the sintered R-T-B based magnet work that is ascribable to the RL-RH-M based alloy is less than 0.1 mass %, the effect of $H_{cJ}$ improvement due to RH may not be obtained; if it exceeds 0.6 mass %, it may be impossible to obtain a sintered R-T-B based magnet having high $H_{cJ}$ while reducing the amount of any heavy rare-earth element used. Preferably, the adhering amount of RH to the sintered R-T-B based magnet work that is ascribable to the RL-RH-M based alloy is not less than 0.1 mass % and not more than 0.5 mass %.

Herein, the "adhering amount of RH" is an amount of RH that is contained in the RL-RH-M based alloy adhering to the sintered R-T-B based magnet work, and is defined by a mass ratio where the mass of sintered R-T-B based magnet work is regarded as 100 mass %.

If the heating temperature in the diffusion step is less than 700° C., the amount of liquid phase containing RH, RL and M may be too small to obtain high $H_{cJ}$. On the other hand, if it exceeds 1100° C., $H_{cJ}$ may be greatly lowered. Preferably, the heating temperature in the diffusion step is not lower than 800° C. and not higher than 1000° C. This provides a higher $H_{cJ}$. Moreover, preferably, the sintered R-T-B based magnet having undergone the diffusion step (not lower than 700° C. and not higher than 1100° C.) is cooled to 300° C. at a cooling rate of 15° C./minute or more, from the temperature at which the diffusion step was performed. This provides a higher $H_{cJ}$.

The diffusion step can be performed by placing an RL-RH-M alloy in any arbitrary shape on the surface of the sintered R-T-B based magnet work, and using a known heat treatment apparatus. For example, the surface of the sintered R-T-B based magnet work may be covered by a powder layer of the RL-RH-M alloy, and the diffusion step may be performed. For example, an application step of applying an adhesive agent to the surface to receive application, and a step of allowing the RL-RH-M alloy to adhere to the region where the adhesive agent has been applied may be performed. Examples of adhesive agents include PVA (polyvinyl alcohol), PVB (polyvinyl butyral), PVP (polyvinyl pyrrolidone), and the like. In the case where the adhesive agent is an aqueous adhesive agent, the sintered R-T-B based magnet work may be subjected to preliminary heating before the application. The purpose of preliminary heating is to remove excess solvent and control adhesiveness, and to allow the adhesive agent to adhere uniformly. The heating temperature is preferably 60° C. to 200° C. In the case of an organic solvent-type adhesive agent that is highly volatile, this step may be omitted. For example, after a slurry obtained by dispersing the RL-RH-M alloy in a dispersion medium is applied on the surface of the sintered R-T-B based magnet work, the dispersion medium may be evaporated, thus allowing RL-RH-M alloy and the sintered R-T-B based magnet work to adhere. Examples of the dispersion medium may be alcohols (ethanol, etc.), aldehydes, and ketones. Moreover, RH may be introduced by disposing a fluoride, oxide, oxyfluoride, etc., of RH on the surface of the sintered R-T-B based magnet work, together with the RL-M alloy. In other words, so long as RL and M can be simultaneously diffused together with RH, the method thereof may be arbitrary.

The RL-RH-M alloy may be placed at any arbitrary position so long as at least a portion thereof is adhering to at least a portion of the sintered R-T-B based magnet work; however, it is preferable that the RL-RH-M alloy is placed so as to adhere to at least a surface that is perpendicular to the alignment direction of the sintered R-T-B based magnet work. This will allow a liquid phase containing RL, RH and M to be introduced from the magnet surface into the interior more efficiently through diffusion. In this case, the RL-RH-M alloy may adhere in the alignment direction of the sintered R-T-B based magnet work alone, or the RL-RH-M alloy may adhere to the entire surface of the sintered R-T-B based magnet work.

(Step of Performing Heat Treatment)

Preferably, the sintered R-T-B based magnet work having undergone the diffusion step is subjected to a heat treatment at a temperature which is not lower than 400° C. and not higher than 750° C. but which is lower than the temperature effected in the diffusion step, in a vacuum or an inert gas ambient. Performing the heat treatment provides for a higher $H_{cJ}$.

EXAMPLES

The present invention will be described in more detail by way of Examples; however, the present invention is not to be limited thereto.

Experimental Example 1

[Step of Providing Sintered R-T-B Based Magnet Work (Magnet Work)]

Respective elements were weighed so that the R1-T1-B based sintered compact would result in a magnet work composition indicated at Label 1-A in Table 1, and through casting by a strip casting method, a raw material alloy in flake form having a thickness of 0.2 to 0.4 mm was obtained. After the resultant raw material alloy in flake form was hydrogen-pulverized, it was subjected to a dehydrogenation treatment of heating to 550° C. in a vacuum and then cooling, whereby a coarse-pulverized powder was obtained. Next, to the resultant coarse-pulverized powder, zinc stearate was added as a lubricant in an amount of 0.04 mass % relative to 100 mass % of coarse-pulverized powder; after mixing, an airflow crusher (jet mill machine) was used to effect dry milling in a nitrogen jet, whereby a fine-pulverized powder (alloy powder) with a particle size D50 of 4 μm was obtained. Note that the particle size $D_{50}$ is a central value of volume (volume median particle diameter) as obtained by a laser diffraction method by airflow dispersion technique.

To the fine-pulverized powder, zinc stearate was added as a lubricant in an amount of 0.05 mass % relative to 100 mass % of fine-pulverized powder; after mixing, the fine-pulverized powder was pressed in a magnetic field, whereby a compact was obtained. As a pressing apparatus, a so-called orthogonal magnetic field pressing apparatus (transverse magnetic field pressing apparatus) was used, in which the direction of magnetic field application ran orthogonal to the pressurizing direction.

The resultant compact was sintered for 4 hours in a vacuum (while selecting a temperature at which a sufficiently dense texture would result through sintering) and thereafter rapidly cooled, whereby a magnet work was obtained. The resultant magnet work had a density of 7.5 $Mg/m^3$ or more. A component analysis of the resultant magnet work is shown in Table 1. The respective components in Table 1 were measured by using Inductively Coupled Plasma Optical Emission Spectroscopy (ICP-OES). The oxygen amount in the magnet work was measured by a gas fusion infrared absorption method, which all indicated a value around 0.1 mass %. The C (carbon amount) was measured with a gas analyzer based on a combustion-infrared absorption method, which indicated a value around 0.1 mass %. In Table 1, "[T]/[B]" is a ratio (a/b) between: a total (a) of the respective value of a result of dividing an analysis value (mass %) of each element (Fe, Co, Al, Si, Mn) composing T with the atomic weight of that element; and (b) a result of dividing an analysis value (mass %) of B with the atomic weight of B. The same also applies to any other tables. Note that the composition, the oxygen amount, and the carbon amount in Table 1 do not total to 100 mass %. This is because the method of analysis differs for each component. The same also applies to any other tables.

TABLE 1

| | sintered R-T-B based magnet work composition (mass %) | | | | | | | | | | |
|---|---|---|---|---|---|---|---|---|---|---|---|
| | R | | T | | | | | | | | |
| Label | Nd | Pr | Fe | Co | Al | Si | Mn | Ga | Cu | B | [T]/[B] |
| 1-A | 22.6 | 7.2 | 66.1 | 0.87 | 0.12 | 0.03 | 0.02 | 0.42 | 0.14 | 0.90 | 14.5 |

[Step of Providing RL-RH-M Based Alloy]

Raw materials of the respective elements were weighed so as to result in the RL-RH-M based alloy composition indicated as Label 1-a in Table 2, and these raw materials were melted, thereby providing an alloy in a ribbon shape or flake shapes by a single-roll rapid quenching technique (melt spinning technique). The composition of the resultant RL-RH-M based alloy is shown in Table 2. The respective components in Table 2 were measured by using Inductively Coupled Plasma Optical Emission Spectroscopy (ICP-OES).

TABLE 2

| | RL-RH-M based alloy composition (mass %) | | | |
|---|---|---|---|---|
| Label | Pr | Tb | Ga | Cu |
| 1-a | 82.6 | 5.8 | 6.7 | 2.8 |

[Diffusion Step]

The sintered R-T-B based magnet work of Label 1-A in Table 1 was cut and ground into a 7.2 mm×7.2 mm×7.2 mm cube. Dipping technique was used for the sintered R-T-B based magnet work after the process, whereby PVA was applied as an adhesive agent on the entire surface of the sintered R-T-B based magnet work. Next, under the producing conditions shown in Table 3, the RL-RH-M based alloy was allowed to adhere to the entire surface of the sintered R-T-B based magnet work having the adhesive agent applied thereto. The adhering amount of the RL-RH-M based alloy and the adhering amount of RH were adjusted by, after pulverizing the RL-RH-M based alloy in an argon ambient by using a mortar, passing it through different kinds of sieves with opening of 38 to 1000 μm to give RL-RH-M based alloys with different particle sizes. Then, in argon which was controlled to a reduced pressure of 200 Pa, the RL-RH-M based alloy and the sintered R-T-B based magnet work were heated by using a vacuum heat treatment furnace under the conditions indicated for the diffusion step in Table 3, and thereafter cooled.

[Step of Performing Heat Treatment]

In argon which was controlled to a reduced pressure of 200 Pa, the sintered R-T-B based magnet having undergone the diffusion step was subjected to a heat treatment by using a vacuum heat treatment furnace, whereby it was heated at 500° C. A surface grinder was used on each sample having undergone the heat treatment to grind the entire surface of the sample, whereby samples (sintered R-T-B based magnets) respectively in the form of a 7.0 mm×7.0 mm×7.0 mm cube were obtained. Note that the heating temperature for the RL-RH-M based alloy and the sintered R-T-B based magnet work in the diffusion step, and the heating temperature for the sintered R-T-B based magnet work in the step of performing heat treatment following the diffusion step were measured with a thermocouple.

[Sample Evaluations]

With respect to the resultant samples, $B_r$ and $H_{cJ}$ of each sample were measured by using a B-H tracer. Results of measurement are shown in Table 3. From Table 3, it can be seen that the examples of the present invention, i.e., sample Nos. 1-4 through 1-7, all attained high $B_r$ and high $H_{cJ}$ while reducing the amount of any heavy rare-earth element used. On the other hand, sample Nos. 1-1 through 1-3, in which the adhering amount of the RL-RH-M based alloy was less than 4 mass %, did not attain high $H_{cJ}$. Furthermore, in sample No. 1-9, in which the adhering amount of the RL-RH-M based alloy exceeded 15 mass %, Br was greatly reduced. Although sample No. 1-8 attained high $B_r$ and high $H_{cJ}$, the adhering amount of RH exceeded 0.6 mass %, and the effect of $H_{cJ}$ improvement was low (i.e., $H_{cJ}$ hardly improved over that of No. 1-7; and $B_r$ lowered). This makes it impossible to obtain a sintered R-T-B based magnet having high $B_r$ and high $H_{cJ}$ while reducing the amount of any heavy rare-earth element used

TABLE 3

| | producing conditions | | | | | | | | |
|---|---|---|---|---|---|---|---|---|---|
| Sample No. | sintered R-T-B based magnet work Label | RL-RH-M based alloy Label | RH amount in RL-RH-M based alloy (mass %) | adhering amount of RL-RH-M based alloy (mass %) | adhering amount of RH (mass %) | diffusion step | Br (T) | HcJ (kA/m) | Notes |
| 1-1 | 1-A | 1-a | 5.8 | 0.7 | 0.04 | 900° C. × 10 h | 1.39 | 1459 | Comp. |
| 1-2 | 1-A | 1-a | 5.8 | 1.3 | 0.07 | 900° C. × 10 h | 1.39 | 1606 | Comp. |
| 1-3 | 1-A | 1-a | 5.8 | 2.2 | 0.13 | 900° C. × 10 h | 1.38 | 1712 | Comp. |
| 1-4 | 1-A | 1-a | 5.8 | 4.0 | 0.23 | 900° C. × 10 h | 1.38 | 1915 | Inv. |
| 1-5 | 1-A | 1-a | 5.8 | 5.1 | 0.29 | 900° C. × 10 h | 1.37 | 1957 | Inv. |
| 1-6 | 1-A | 1-a | 5.8 | 8.3 | 0.48 | 900° C. × 10 h | 1.35 | 2001 | Inv. |
| 1-7 | 1-A | 1-a | 5.8 | 10.0 | 0.58 | 900° C. × 10 h | 1.34 | 2061 | Inv. |
| 1-8 | 1-A | 1-a | 5.8 | 13.0 | 0.75 | 900° C. × 10 h | 1.32 | 2099 | Comp. |
| 1-9 | 1-A | 1-a | 5.8 | 17.5 | 1.01 | 900° C. × 10 h | 1.29 | 2120 | Comp. |

Experimental Example 2

[Step of Providing Sintered R-T-B Based Magnet Work (Magnet Work)]

Respective elements were weighed so that the R1-T1-B based sintered compact would result in a magnet work composition indicated at Label 2-A in Table 4, and through casting by a strip casting method, a raw material alloy in flake form having a thickness of 0.2 to 0.4 mm was obtained. After the resultant raw material alloy in flake form was hydrogen-pulverized, it was subjected to a dehydrogenation treatment of heating to 550° C. in a vacuum and then cooling, whereby a coarse-pulverized powder was obtained. Next, to the resultant coarse-pulverized powder, zinc stearate was added as a lubricant in an amount of 0.04 mass % relative to 100 mass % of coarse-pulverized powder; after mixing, an airflow crusher (jet mill machine) was used to effect dry milling in a nitrogen jet, whereby a fine-pulverized powder (alloy powder) with a particle size D50 of 4 μm was obtained. Note that the particle size $D_{50}$ is a central value of volume (volume median particle diameter) as obtained by a laser diffraction method by airflow dispersion technique.

To the fine-pulverized powder, zinc stearate was added as a lubricant in an amount of 0.05 mass % relative to 100 mass % of fine-pulverized powder; after mixing, the fine-pulverized powder was pressed in a magnetic field, whereby a compact was obtained. As a pressing apparatus, a so-called orthogonal magnetic field pressing apparatus (transverse magnetic field pressing apparatus) was used, in which the direction of magnetic field application ran orthogonal to the pressurizing direction.

The resultant compact was sintered for 4 hours in a vacuum (while selecting a temperature at which a sufficiently dense texture would result through sintering) and thereafter rapidly cooled, whereby a magnet work was obtained. The resultant magnet work had a density of 7.5 $Mg/m^3$ or more. A component analysis of the resultant magnet work is shown in Table 4. The respective components in Table 4 were measured by using Inductively Coupled Plasma Optical Emission Spectroscopy (ICP-OES). The oxygen amount in the magnet work was measured by a gas fusion infrared absorption method, which all indicated a value around 0.1 mass %. The C (carbon amount) was measured with a gas analyzer based on a combustion-infrared absorption method, which indicated a value around 0.1 mass %.

TABLE 4

| | sintered R-T-B based magnet work composition (mass %) | | | | | | | | | | |
|---|---|---|---|---|---|---|---|---|---|---|---|
| | R | | T | | | | | | | | |
| Label | Nd | Pr | Fe | Co | Al | Si | Mn | Ga | Cu | B | [T]/[B] |
| 2-A | 22.6 | 7.2 | 66.1 | 0.87 | 0.12 | 0.03 | 0.02 | 0.42 | 0.14 | 0.90 | 14.5 |

[Step of Providing RL-RH-M Based Alloy]

Raw materials of the respective elements were weighed so as to result in the RL-RH-M based alloy compositions indicated as Labels 2-a through 2-g in Table 5, and these raw materials were melted, thereby providing an alloy in a ribbon shape or flake shapes by a single-roll rapid quenching technique (melt spinning technique). The compositions of the resultant RL-RH-M based alloys are shown in Table 5. The respective components in Table 5 were measured by using Inductively Coupled Plasma Optical Emission Spectroscopy (ICP-OES).

TABLE 5

| | RL-RH-M based alloy composition (mass %) | | | |
|---|---|---|---|---|
| Label | Pr | Tb | Ga | Cu |
| 2-a | 88.3 | 0.5 | 6.9 | 3.0 |
| 2-b | 88.3 | 1.0 | 6.8 | 2.9 |
| 2-c | 87.2 | 1.9 | 6.8 | 2.8 |
| 2-d | 81.7 | 3.9 | 9.9 | 3.8 |
| 2-e | 82.6 | 5.8 | 6.7 | 2.8 |
| 2-f | 81.1 | 7.8 | 6.7 | 2.7 |
| 2-g | 74.9 | 10.0 | 6.6 | 2.8 |

[Diffusion Step]

The sintered R-T-B based magnet work of Label 2-A in Table 4 was cut and ground into a 7.2 mm×7.2 mm×7.2 mm cube. Dipping technique was used for the sintered R-T-B based magnet work after the process, whereby PVA was applied as an adhesive agent on the entire surface of the sintered R-T-B based magnet work. Next, under the producing conditions shown in Table 6, the RL-RH-M based alloy was allowed to adhere to the entire surface of the sintered R-T-B based magnet work having the adhesive agent applied thereto. The adhering amount of the RL-RH-M based alloy and the adhering amount of RH were adjusted by, after pulverizing the RL-RH-M based alloy in an argon ambient by using a mortar, passing it through different kinds of sieves with opening of 38 to 1000 μm to give RL-RH-M based alloys with different particle sizes. Then, in argon which was controlled to a reduced pressure of 200 Pa, the RL-RH-M based alloy and the sintered R-T-B based magnet work were heated by using a vacuum heat treatment furnace under the conditions indicated for the diffusion step in Table 6, and thereafter cooled.

[Step of Performing Heat Treatment]

In argon which was controlled to a reduced pressure of 200 Pa, the sintered R-T-B based magnet having undergone the diffusion step was subjected to a heat treatment by using a vacuum heat treatment furnace, whereby it was heated at 500° C. A surface grinder was used on each sample having undergone the heat treatment to grind the entire surface of the sample, whereby samples (sintered R-T-B based magnets) respectively in the form of a 7.0 mm×7.0 mm×7.0 mm cube were obtained. Note that the heating temperature for the RL-RH-M based alloy and the sintered R-T-B based magnet work in the diffusion step, and the heating temperature for the sintered R-T-B based magnet work in the step of performing heat treatment following the diffusion step were measured with a thermocouple.

[Sample Evaluations]

With respect to the resultant samples, $B_r$ and $H_{cJ}$ of each sample were measured by using a B-H tracer. Results of measurement are shown in Table 6. From Table 6, it can be seen that the examples of the present invention, i.e., sample Nos. 2-2 through 2-7, all attained high $B_r$ and high $H_{cJ}$ while reducing the amount of any heavy rare-earth element used. On the other hand, sample No. 2-1, in which the RH amount in the RL-RH-M based alloy was less than 1%, did not attain high $H_{cJ}$. Although sample No. 2-8 attained high $B_r$ and high $H_{cJ}$, the RH amount in the RL-RH-M based alloy exceeded 8%, and the adhering amount of RH exceeded 0.6 mass %, and the effect of $H_{cJ}$ improvement was low (i.e., $H_{cJ}$ hardly improved over that of No. 2-7). This makes it impossible to obtain a sintered R-T-B based magnet having high $B_r$ and high $H_{cJ}$ while reducing the amount of any heavy rare-earth element used.

TABLE 6

| | producing conditions | | | | | | | | |
|---|---|---|---|---|---|---|---|---|---|
| Sample No. | sintered R-T-B based magnet work Label | RL-RH-M based alloy Label | RH amount in RL-RH-M based alloy (mass %) | adhering amount of RL-RH-M based alloy (mass %) | adhering amount of RH (mass %) | diffusion step | Br (T) | HcJ (kA/m) | Notes |
| 2-1 | 2-A | 2-a | 0.5 | 5.2 | 0.03 | 900° C. × 10 h | 1.41 | 1488 | Comp. |
| 2-2 | 2-A | 2-b | 1.0 | 5.0 | 0.05 | 900° C. × 10 h | 1.40 | 1751 | Inv. |
| 2-3 | 2-A | 2-c | 1.9 | 5.1 | 0.10 | 900° C. × 10 h | 1.39 | 1782 | Inv. |
| 2-4 | 2-A | 2-d | 3.9 | 5.1 | 0.20 | 900° C. × 10 h | 1.38 | 1856 | Inv. |
| 2-5 | 2-A | 2-d | 3.9 | 15.0 | 0.59 | 900° C. × 10 h | 1.36 | 2101 | Inv. |
| 2-6 | 2-A | 2-e | 5.8 | 5.1 | 0.29 | 900° C. × 10 h | 1.37 | 1957 | Inv. |
| 2-7 | 2-A | 2-f | 7.8 | 5.2 | 0.41 | 900° C. × 10 h | 1.37 | 1974 | Inv. |
| 2-8 | 2-A | 2-g | 10.8 | 5.7 | 0.62 | 900° C. × 10 h | 1.37 | 1980 | Comp. |

Experimental Example 3

[Step of Providing Sintered R-T-B Based Magnet Work (Magnet Work)]

Respective elements were weighed so that the R1-T1-B based sintered compact would result in a magnet work composition indicated at Label 3-A in Table 7, and through casting by a strip casting method, a raw material alloy in flake form having a thickness of 0.2 to 0.4 mm was obtained. After the resultant raw material alloy in flake form was hydrogen-pulverized, it was subjected to a dehydrogenation treatment of heating to 550° C. in a vacuum and then cooling, whereby a coarse-pulverized powder was obtained.

Next, to the resultant coarse-pulverized powder, zinc stearate was added as a lubricant in an amount of 0.04 mass % relative to 100 mass % of coarse-pulverized powder; after mixing, an airflow crusher (jet mill machine) was used to effect dry milling in a nitrogen jet, whereby a fine-pulverized powder (alloy powder) with a particle size D50 of 4 μm was obtained. Note that the particle size $D_{50}$ is a central value of volume (volume median particle diameter) as obtained by a laser diffraction method by airflow dispersion technique.

To the fine-pulverized powder, zinc stearate was added as a lubricant in an amount of 0.05 mass % relative to 100 mass % of fine-pulverized powder; after mixing, the fine-pulverized powder was pressed in a magnetic field, whereby a compact was obtained. As a pressing apparatus, a so-called orthogonal magnetic field pressing apparatus (transverse magnetic field pressing apparatus) was used, in which the direction of magnetic field application ran orthogonal to the pressurizing direction.

The resultant compact was sintered for 4 hours in a vacuum (while selecting a temperature at which a sufficiently dense texture would result through sintering) and thereafter rapidly cooled, whereby a magnet work was obtained. The resultant magnet work had a density of 7.5 $Mg/m^3$ or more. A component analysis of the resultant magnet work is shown in Table 7. The respective components in Table 7 were measured by using Inductively Coupled Plasma Optical Emission Spectroscopy (ICP-OES). The oxygen amount in the magnet work was measured by a gas fusion infrared absorption method, which all indicated a value around 0.1 mass %. The C (carbon amount) was measured with a gas analyzer based on a combustion-infrared absorption method, which indicated a value around 0.1 mass %.

TABLE 7

| | sintered R-T-B based magnet work composition (mass %) | | | | | | | | | | |
|---|---|---|---|---|---|---|---|---|---|---|---|
| | R | | T | | | | | | | | |
| Label | Nd | Pr | Fe | Co | Al | Si | Mn | Ga | Cu | B | [T]/[B] |
| 3-A | 22.6 | 7.2 | 66.1 | 0.87 | 0.12 | 0.03 | 0.02 | 0.42 | 0.14 | 0.90 | 14.5 |

[Step of Providing RL-RH-M Based Alloy]

Raw materials of the respective elements were weighed so as to result in the RL-RH-M based alloy composition indicated as Label 3-a in Table 8, and these raw materials were melted, thereby providing an alloy in a ribbon shape or flake shapes by a single-roll rapid quenching technique (melt spinning technique). Using a mortar, the resultant alloy was pulverized in an argon ambient, and thereafter was passed through a sieve with an opening of 300 μm, thereby providing an RL-RH-M based alloy. The composition of the resultant RL-RH-M based alloy is shown in Table 8. The respective components in Table 8 were measured by using Inductively Coupled Plasma Optical Emission Spectroscopy (ICP-OES).

TABLE 8

| | RL-RH-M based alloy composition (mass %) | | | |
|---|---|---|---|---|
| Label | Pr | Tb | Ga | Cu |
| 3-a | 82.6 | 5.8 | 6.7 | 2.8 |

[Diffusion Step]

The sintered R-T-B based magnet work of Label 3-A in Table 9 was cut and ground into a 7.2 mm×7.2 mm×7.2 mm cube. Dipping technique was used for the sintered R-T-B based magnet work after the process, whereby PVA was applied as an adhesive agent on the entire surface of the sintered R-T-B based magnet work. Next, under the producing conditions shown in Table 9, the RL-RH-M based alloy was allowed to adhere to the entire surface of the sintered R-T-B based magnet work having the adhesive agent applied thereto. Then, in argon which was controlled to a reduced pressure of 200 Pa, the RL-RH-M based alloy and the sintered R-T-B based magnet work were heated by using a vacuum heat treatment furnace under the conditions indicated for the diffusion step in Table 9, and thereafter cooled.

[Step of Performing Heat Treatment]

In argon which was controlled to a reduced pressure of 200 Pa, the sintered R-T-B based magnet having undergone the diffusion step was subjected to a heat treatment by using a vacuum heat treatment furnace, whereby it was heated at 500° C. A surface grinder was used on each sample having undergone the heat treatment to grind the entire surface of the sample, whereby samples (sintered R-T-B based magnets) respectively in the form of a 7.0 mm×7.0 mm×7.0 mm cube were obtained. Note that the heating temperature for the RL-RH-M based alloy and the sintered R-T-B based magnet work in the diffusion step, and the heating temperature for the sintered R-T-B based magnet work in the step of performing heat treatment following the diffusion step were measured with a thermocouple.

[Sample Evaluations]

With respect to the resultant samples, $B_r$ and $H_{cJ}$ of each sample were measured by using a B-H tracer. Results of measurement are shown in Table 9. From Table 9, it can be seen that the examples of the present invention, i.e., sample Nos. 3-2 through 3-8, all attained high $B_r$ and high $H_{cJ}$ while reducing the amount of any heavy rare-earth element used. On the other hand, sample No. 3-1, in which the processing temperature in the diffusion step was less than 700° C., did not attain high $H_{cJ}$. Furthermore, sample No. 3-9, in which the processing temperature in the diffusion step exceeded 1100° C., $B_r$ and $H_{cJ}$ were greatly reduced.

Experimental Example 4

[Step of Providing Sintered R-T-B Based Magnet Work (Magnet Work)]

Respective elements were weighed so that the R1-T1-B based sintered compact would result in a magnet work composition indicated at Labels 4-A through 4-D in Table 10, and through casting by a strip casting method, a raw material alloy in flake form having a thickness of 0.2 to 0.4 mm was obtained. After the resultant raw material alloy in flake form was hydrogen-pulverized, it was subjected to a dehydrogenation treatment of heating to 550° C. in a vacuum and then cooling, whereby a coarse-pulverized powder was obtained. Next, to the resultant coarse-pulverized powder, zinc stearate was added as a lubricant in an amount of 0.04 mass % relative to 100 mass % of coarse-pulverized powder; after mixing, an airflow crusher (jet mill machine) was used to effect dry milling in a nitrogen jet, whereby a fine-pulverized powder (alloy powder) with a particle size D50 of 4 μm was obtained. Note that the particle size $D_{50}$ is a central value of volume (volume median particle diameter) as obtained by a laser diffraction method by airflow dispersion technique.

To the fine-pulverized powder, zinc stearate was added as a lubricant in an amount of 0.05 mass % relative to 100 mass % of fine-pulverized powder; after mixing, the fine-pulverized powder was pressed in a magnetic field, whereby a compact was obtained. As a pressing apparatus, a so-called orthogonal magnetic field pressing apparatus (transverse magnetic field pressing apparatus) was used, in which the direction of magnetic field application ran orthogonal to the pressurizing direction.

The resultant compact was sintered for 4 hours in a vacuum at not lower than 1000° C. and not higher than 1050° C. (i.e., a temperature at which a sufficiently dense texture would result through sintering was selected for each sample) and thereafter rapidly cooled, whereby a magnet work was obtained. The resultant magnet work had a density of 7.5 $Mg/m^3$ or more. A component analysis of the resultant magnet work is shown in Table 10. The respective components in Table 10 were measured by using Inductively Coupled Plasma Optical Emission Spectroscopy (ICP-OES). The oxygen amount in the magnet work was measured by a gas fusion infrared absorption method, which all indicated a value around 0.1 mass %. The C (carbon amount) was measured with a gas analyzer based on a combustion-infrared absorption method, which indicated a value around 0.1 mass %.

TABLE 9

| | producing conditions | | | | | | | | |
|---|---|---|---|---|---|---|---|---|---|
| Sample No. | sintered R-T-B based magnet work Label | RL-RH-M based alloy Label | RH amount in RL-RH-M based alloy (mass %) | adhering amount of RL-RH-M based alloy (mass %) | adhering amount of RH (mass %) | diffusion step | Br (T) | HcJ (kA/m) | Notes |
| 3-1 | 3-A | 3-a | 5.8 | 5.0 | 0.29 | 600° C. × 10 h | 1.42 | 1501 | Comp. |
| 3-2 | 3-A | 3-a | 5.8 | 5.0 | 0.29 | 700° C. × 10 h | 1.41 | 1678 | Inv. |
| 3-3 | 3-A | 3-a | 5.8 | 5.0 | 0.29 | 800° C. × 10 h | 1.39 | 1777 | Inv. |
| 3-4 | 3-A | 3-a | 5.8 | 5.1 | 0.30 | 850° C. × 10 h | 1.38 | 1899 | Inv. |
| 3-5 | 3-A | 3-a | 5.8 | 5.1 | 0.29 | 900° C. × 10 h | 1.37 | 1957 | Inv. |
| 3-6 | 3-A | 3-a | 5.8 | 5.1 | 0.30 | 950° C. × 10 h | 1.37 | 1925 | Inv. |
| 3-7 | 3-A | 2-g | 5.8 | 5.2 | 0.30 | 1000° C. × 10 h | 1.37 | 1889 | Inv. |
| 3-8 | 3-A | 2-g | 5.8 | 5.1 | 0.30 | 1100° C. × 10 h | 1.37 | 1866 | Inv. |
| 3-9 | 3-A | 2-g | 5.8 | 5.0 | 0.29 | 1150° C. × 10 h | 1.31 | 1020 | Comp. |

TABLE 10

| | sintered R-T-B based magnet work composition (mass %) | | | | | | | | |
|---|---|---|---|---|---|---|---|---|---|
| | R | | T | | | | | | [T]/ |
| Label | Nd | Pr | Fe | Co | Al | Si | Mn | B | [B] |
| 4-A | 23.5 | 5.8 | 67.9 | 0.5 | 0.1 | 0.03 | 0.03 | 0.96 | 13.8 |
| 4-B | 23.5 | 5.8 | 68.0 | 0.5 | 0.1 | 0.03 | 0.03 | 0.95 | 14.0 |
| 4-C | 23.5 | 5.8 | 68.0 | 0.5 | 0.1 | 0.03 | 0.03 | 0.92 | 14.5 |
| 4-D | 23.4 | 5.8 | 68.1 | 0.5 | 0.1 | 0.03 | 0.03 | 0.89 | 14.9 |

[Step of Providing RL-RH-M Based Alloy]

Raw materials of the respective elements were weighed so as to result in the RL-RH-M based alloy composition indicated as Label 4-a in Table 11, and these raw materials were melted, thereby providing an alloy in a ribbon shape or flake shapes by a single-roll rapid quenching technique (melt spinning technique). Using a mortar, the resultant alloy was pulverized in an argon ambient, and thereafter was passed through a sieve with an opening of 300 μm, thereby providing an RL-RH-M based alloy. The composition of the resultant RL-RH-M based alloy is shown in Table 11. The respective components in Table 11 were measured by using Inductively Coupled Plasma Optical Emission Spectroscopy (ICP-OES).

TABLE 11

| | RL-RH-M based alloy composition (mass %) | | | |
|---|---|---|---|---|
| Label | Pr | Tb | Ga | Cu |
| 4-a | 81.7 | 3.9 | 9.9 | 3.8 |

[Diffusion Step]

The sintered R-T-B based magnet works of Label 4-A through 4-D in Table 10 were cut and ground into a 7.2 mm×7.2 mm×7.2 mm cube. Dipping technique was used for each sintered R-T-B based magnet work after the process, whereby PVA was applied as an adhesive agent on the entire surface of the sintered R-T-B based magnet work. Next, under the producing conditions shown in Table 12, the RL-RH-M based alloy was allowed to adhere to the entire surface of the sintered R-T-B based magnet work having the adhesive agent applied thereto. Then, in argon which was controlled to a reduced pressure of 200 Pa, the RL-RH-M based alloy and the sintered R-T-B based magnet work were heated by using a vacuum heat treatment furnace under the conditions indicated for the diffusion step in Table 12, and thereafter cooled.

[Step of Performing Heat Treatment]

In argon which was controlled to a reduced pressure of 200 Pa, the sintered R-T-B based magnet having undergone the diffusion step was subjected to a heat treatment by using a vacuum heat treatment furnace, whereby it was heated at 500° C. A surface grinder was used on each sample having undergone the heat treatment to grind the entire surface of the sample, whereby samples (sintered R-T-B based magnets) respectively in the form of a 7.0 mm×7.0 mm×7.0 mm cube were obtained. Note that the heating temperature for the RL-RH-M based alloy and the sintered R-T-B based magnet work in the diffusion step, and the heating temperature for the sintered R-T-B based magnet work in the step of performing heat treatment following the diffusion step were measured with a thermocouple.

[Sample Evaluations]

With respect to the resultant samples, $B_r$ and $H_{cJ}$ of each sample were measured by using a B-H tracer. Results of measurement are shown in Table 12. From Table 12, it can be seen that the examples of the present invention, i.e., sample Nos. 4-1 through 4-4, all attained high $B_r$ and high $H_{cJ}$ while reducing the amount of any heavy rare-earth element used.

TABLE 12

| | producing conditions | | | | | | | | |
|---|---|---|---|---|---|---|---|---|---|
| Sample No. | sintered R-T-B based magnet work Label | RL-RH-M based alloy Label | RH amount in RL-RH-M based alloy (mass %) | adhering amount of RL-RH-M based alloy (mass %) | adhering amount of RH (mass %) | diffusion step | Br (T) | HcJ (kA/m) | Notes |
| 4-1 | 4-A | 4-a | 3.9 | 4.4 | 0.17 | 900° C. × 10 h | 1.46 | 1658 | Inv. |
| 4-2 | 4-B | 4-a | 3.9 | 6.5 | 0.26 | 900° C. × 10 h | 1.45 | 1894 | Inv. |
| 4-3 | 4-C | 4-a | 3.9 | 6.5 | 0.25 | 900° C. × 10 h | 1.38 | 2086 | Inv. |
| 4-4 | 4-D | 4-a | 3.9 | 6.6 | 0.26 | 900° C. × 10 h | 1.36 | 2119 | Inv. |

Example 5

[Step of Providing Sintered R-T-B Based Magnet Work (Magnet Work)]

Respective elements were weighed so that the R1-T1-B based sintered compact would result in a magnet work composition indicated at Label 5-A in Table 13, and through casting by a strip casting method, a raw material alloy in flake form having a thickness of 0.2 to 0.4 mm was obtained. After the resultant raw material alloy in flake form was hydrogen-pulverized, it was subjected to a dehydrogenation treatment of heating to 550° C. in a vacuum and then cooling, whereby a coarse-pulverized powder was obtained. Next, to the resultant coarse-pulverized powder, zinc stearate was added as a lubricant in an amount of 0.04 mass % relative to 100 mass % of coarse-pulverized powder; after mixing, an airflow crusher (jet mill machine) was used to effect dry milling in a nitrogen jet, whereby a fine-pulverized powder (alloy powder) with a particle size D50 of 4 μm was obtained. Note that the particle size $D_{50}$ is a central value of volume (volume median particle diameter) as obtained by a laser diffraction method by airflow dispersion technique.

To the fine-pulverized powder, zinc stearate was added as a lubricant in an amount of 0.05 mass % relative to 100 mass % of fine-pulverized powder; after mixing, the fine-pulverized powder was pressed in a magnetic field, whereby a compact was obtained. As a pressing apparatus, a so-called orthogonal magnetic field pressing apparatus (transverse magnetic field pressing apparatus) was used, in which the direction of magnetic field application ran orthogonal to the pressurizing direction.

The resultant compact was sintered for 4 hours in a vacuum at 1040° C. (i.e., a temperature at which a sufficiently dense texture would result through sintering was selected) and thereafter rapidly cooled, whereby a magnet work was obtained. The resultant magnet work had a density of 7.5 $Mg/m^3$ or more. A component analysis of the resultant magnet work is shown in Table 13. The respective components in Table 13 were measured by using Inductively Coupled Plasma Optical Emission Spectroscopy (ICP-OES). The oxygen amount in the magnet work was measured by a gas fusion infrared absorption method, which all indicated a value around 0.1 mass %. The C (carbon amount) was measured with a gas analyzer based on a combustion-infrared absorption method, which indicated a value around 0.1 mass %. In Table 13, "[T]/[B]" is a ratio (a/b) between: a total (a) of the respective value of a result of dividing an analysis value (mass %) of each element (which herein are Fe, Al, Si, Mn) composing T with the atomic weight of that element; and (b) a result of dividing an analysis value (mass %) of B with the atomic weight of B. The same also applies to any other tables. Note that the composition, the oxygen amount, and the carbon amount in Table 1 do not total to 100 mass %. This is because the method of analysis differs for each component, as described above. The same also applies to any other tables.

TABLE 13

| | sintered R-T-B based magnet work composition (mass %) | | | | | | | | | | |
|---|---|---|---|---|---|---|---|---|---|---|---|
| | R | | T | | | | | | | | |
| Label | Nd | Pr | Fe | Co | Al | Si | Mn | Ga | Cu | B | [T]/[B] |
| 5-A | 22.6 | 7.2 | 66.1 | 0.87 | 0.12 | 0.03 | 0.02 | 0.42 | 0.14 | 0.90 | 14.5 |

[Step of Providing RL-RH-M Based Alloy]

Raw materials of the respective elements were weighed so as to result in the RL-RH-M based alloy compositions indicated as Labels 5-a through 5-*n* in Table 14, and these raw materials were melted, thereby providing an alloy in a ribbon shape or flake shapes by a single-roll rapid quenching technique (melt spinning technique). Using a mortar, the resultant alloy was pulverized in an argon ambient, and thereafter was passed through a sieve with an opening of 300 μm, thereby providing an RL-RH-M based alloy. The compositions of the resultant RL-RH-M based alloys are shown in Table 14. The respective components in Table 14 were measured by using Inductively Coupled Plasma Optical Emission Spectroscopy (ICP-OES).

TABLE 14

| | RL-RH-M based alloy composition (mass %) | | | | |
|---|---|---|---|---|---|
| Label | Pr | Nd | Tb | Ga | Cu |
| 5-a | 81.6 | — | 8.1 | 7.6 | 1.7 |
| 5-b | 81.1 | — | 7.8 | 6.7 | 2.7 |
| 5-c | 81.2 | — | 7.9 | 5.7 | 3.6 |
| 5-d | 80.9 | — | 8.1 | 5.0 | 4.5 |
| 5-e | 79.6 | — | 8.1 | 4.0 | 5.7 |
| 5-f | 79.9 | — | 7.9 | 3.0 | 6.7 |
| 5-g | 80.2 | — | 8.0 | 2.0 | 7.7 |
| 5-h | 80.5 | — | 8.0 | 0.0 | 9.5 |
| 5-i | 64.2 | 16.1 | 8.1 | 6.7 | 2.7 |
| 5-j | 57.0 | 23.8 | 7.9 | 6.8 | 2.7 |
| 5-k | 49.4 | 31.6 | 8.0 | 6.7 | 2.7 |

TABLE 14-continued

| | RL-RH-M based alloy composition (mass %) | | | | |
|---|---|---|---|---|---|
| Label | Pr | Nd | Tb | Ga | Cu |
| 5-l | 32.2 | 48.0 | 8.2 | 6.7 | 2.7 |
| 5-m | 16.2 | 64.4 | 7.8 | 6.8 | 2.7 |
| 5-n | — | 79.9 | 7.9 | 6.9 | 2.7 |

[Diffusion Step]

The sintered R-T-B based magnet work of Label 5-Ain Table 13 was cut and ground into a 7.2 mm×7.2 mm×7.2 mm cube. Next, dipping technique was used for each sintered R-T-B based magnet work, whereby PVA was applied as an adhesive agent on the entire surface of the sintered R-T-B based magnet work. The RL-RH-M based alloy powder was allowed to adhere to the sintered R-T-B based magnet work having the adhesive agent applied thereto. The RL-RH-M based alloy powder was spread in a process chamber, and allowed to adhere to the entire surface of the sintered R-T-B based magnet work having the adhesive agent applied thereto. Next, in argon which was controlled to a reduced pressure of 200 Pa, by using a vacuum heat treatment furnace, the RL-RH-M based alloy and the sintered R-T-B based magnet work were heated at a temperature indicated for the diffusion step in Table 15 to carry out the diffusion step, and thereafter were cooled.

[Step of Performing Heat Treatment]

In argon which was controlled to a reduced pressure of 200 Pa, the sintered R-T-B based magnet work having undergone the diffusion step was subjected to a heat treatment at 500° C. by using a vacuum heat treatment furnace, and thereafter cooled. A surface grinder was used on each sample having undergone the heat treatment to grind the entire surface of the sample, whereby samples (sintered R-T-B based magnets) respectively in the form of a 7.0 mm×7.0 mm×7.0 mm cube were obtained. Note that the heating temperature for the RL-RH-M based alloy and the sintered R-T-B based magnet work in the diffusion step, and the heating temperature for the sintered R-T-B based magnet work in the step of performing heat treatment following the diffusion step were measured with a thermocouple.

[Sample Evaluations]

With respect to the resultant samples, $B_r$ and $H_{cJ}$ of each sample were measured by using a B-H tracer. Results of measurement are shown in Table 15. Results of measuring the components of each sample by using Inductively Coupled Plasma Optical Emission Spectroscopy (ICP-OES) are shown in Table 53. From Table 15, it can be seen that the examples of the present invention, i.e., sample Nos. 5-1 through 5-14, all attained high Br and high $H_{cJ}$.

TABLE 15

| Sample No. | producing conditions: sintered R-T-B based magnet work Label | RL-RH-M based alloy Label | RH amount in RL-RH-M based alloy (mass %) | adhering amount of RL-RH-M based alloy (mass %) | adhering amount of RH (mass %) | diffusion step | Br (T) | HcJ (kA/m) | Notes |
|---|---|---|---|---|---|---|---|---|---|
| 5-1 | 5-A | 5-a | 8.1 | 6.9 | 0.56 | 900° C. × 10 h | 1.34 | 1962 | Inv. |
| 5-2 | 5-A | 5-b | 7.8 | 5.2 | 0.41 | 900° C. × 10 h | 1.35 | 1956 | Inv. |
| 5-3 | 5-A | 5-c | 7.9 | 7.2 | 0.57 | 900° C. × 10 h | 1.37 | 1965 | Inv. |
| 5-4 | 5-A | 5-d | 8.1 | 5.4 | 0.43 | 900° C. × 10 h | 1.36 | 1958 | Inv. |
| 5-5 | 5-A | 5-e | 8.1 | 5.2 | 0.42 | 900° C. × 10 h | 1.38 | 1946 | Inv. |
| 5-6 | 5-A | 5-f | 7.9 | 5.5 | 0.43 | 900° C. × 10 h | 1.38 | 1957 | Inv. |
| 5-7 | 5-A | 5-g | 8.0 | 6.4 | 0.51 | 900° C. × 10 h | 1.39 | 1909 | Inv. |
| 5-8 | 5-A | 5-h | 8.0 | 6.7 | 0.54 | 900° C. × 10 h | 1.40 | 1884 | Inv. |
| 5-9 | 5-A | 5-i | 8.1 | 7.2 | 0.58 | 900° C. × 10 h | 1.36 | 1958 | Inv. |
| 5-10 | 5-A | 5-j | 7.9 | 5.9 | 0.47 | 900° C. × 10 h | 1.36 | 1940 | Inv. |
| 5-11 | 5-A | 5-k | 8.0 | 6.7 | 0.54 | 900° C. × 10 h | 1.36 | 1946 | Inv. |
| 5-12 | 5-A | 5-I | 8.2 | 4.8 | 0.39 | 900° C. × 10 h | 1.38 | 1888 | Inv. |
| 5-13 | 5-A | 5-m | 7.8 | 6.8 | 0.53 | 900° C. × 10 h | 1.37 | 1893 | Inv. |
| 5-14 | 5-A | 5-n | 7.9 | 4.7 | 0.37 | 900° C. × 10 h | 1.37 | 1819 | Inv. |

According to the present disclosure, a sintered R-T-B based magnet with high remanence and high coercivity can be produced. A sintered magnet according to the present disclosure is suitable for various motors such as motors to be mounted in hybrid vehicles, home appliance products, etc., that are exposed to high temperatures.

This application is based on Japanese Patent Applications No. 2019-012162 filed on Jan. 28, 2019 and No. 2019-176504 filed on Sep. 27, 2019 the entire contents of which are hereby incorporated by reference.

What is claimed is:

1. A method for producing a sintered R-T-B based magnet, comprising:

a step of providing a sintered R-T-B based magnet work;

a step of providing an RL-RH-M based alloy;

a diffusion step of allowing at least a portion of the RL-RH-M based alloy to adhere to at least a portion of a surface of the sintered R-T-B based magnet work, and conducting a heating at a temperature which is not lower than 700° C. and not higher than 1100° C. in a vacuum or an inert gas ambient, wherein in the diffusion step, an adhering amount of the RL-RH-M based alloy to the sintered R-T-B based magnet work is not less than 4 mass % and not more than 15 mass %, and, an adhering amount of RH to the sintered R-T-B based magnet work that is ascribable to the RL-RH-M based alloy is not less than 0.1 mass % and not more than 0.6 mass %;

in the sintered R-T-B based magnet work,

R is a rare-earth element which always includes at least one selected from the group consisting of Nd, Pr and Ce, the R content accounting for not less than 27 mass % and not more than 35 mass % of the entire sintered R-T-B based magnet work; and T includes at least 80% or more of Fe and optionally includes one or more selected from the group consisting of Co, Al, Mn and Si; and in the RL-RH-M based alloy, RL is at least one light rare-earth element which always includes at least one selected from the group consisting of Nd, Pr and Ce, the RL content accounting for not less than 60 mass % and not more than 97 mass % of the entire RL-RH-M based alloy;

RH is at least one selected from the group consisting of Tb, Dy and Ho, the RH content accounting for not less than 1 mass % and not more than 8 mass % of the entire RL-RH-M based alloy; and M is at least one selected from the group consisting of Cu, Ga, Fe, Co, Ni and Al, the M content accounting for not less than 2 mass % and not more than 39 mass % of the entire RL-RH-M based alloy.

2. The method for producing a sintered R-T-B based magnet of claim 1, wherein, in the RL-RH-M based alloy, the RH content accounts for not less than 2 mass % and not more than 6 mass % of the entire RL-RH-M based alloy.

3. The method for producing a sintered R-T-B based magnet of claim 1, wherein, in the diffusion step, the adhering amount of the RL-RH-M based alloy to the sintered R-T-B based magnet work is not less than 5 mass % and not more than 10 mass %.

4. The method for producing a sintered R-T-B based magnet of claim 2, wherein, in the diffusion step, the adhering amount of the RL-RH-M based alloy to the sintered R-T-B based magnet work is not less than 5 mass % and not more than 10 mass %.

* * * * *